United States Patent [19]

Ramer

[11] 4,062,081

[45] Dec. 13, 1977

[54] TRANSPORTABLE BRIDGE AND METHOD

[76] Inventor: James L. Ramer, Rte. 1 Box 155, Sullivan, Mo. 63080

[21] Appl. No.: 731,953

[22] Filed: Oct. 13, 1976

[51] Int. Cl.[2] ..... E01D 15/12

[52] U.S. Cl. ..... 14/1; 14/20; 14/2.4

[58] Field of Search ..... 14/2.4, 1, 18, 3, 19, 14/4, 20, 5; 61/53.68; 52/155, 160, 161, 163

[56] References Cited

U.S. PATENT DOCUMENTS

| | | | |
|---|---|---|---|
| 513,389 | 1/1894 | Greer | 14/20 |
| 665,317 | 1/1901 | Fisher | 14/5 |
| 1,253,809 | 1/1918 | Gelner | 14/18 |
| 1,612,472 | 12/1926 | Scott | 52/162 |
| 1,674,279 | 6/1928 | Ebeling | 14/1 X |
| 2,367,291 | 1/1945 | LeTourneau | 14/1 |
| 2,977,612 | 4/1961 | Frost | 14/2.6 X |
| 3,208,086 | 9/1965 | Gillois | 14/2.6 |
| 3,618,328 | 11/1971 | Nojima | 61/53.68 |
| 3,782,674 | 1/1974 | Smith | 14/5 X |
| 3,953,980 | 5/1976 | Bennett | 14/18 X |

*Primary Examiner*—Nile C. Byers
*Attorney, Agent, or Firm*—Thomas O. Maser; John G. Mannix

[57] ABSTRACT

A transportable bridge is provided which may be erected across a wide, e.g. 150 foot, depression, and with access to only one bank of the depression. The bridge comprises a pair of abutments and a plurality of deck units. The abutments are laterally extensible, and erectible, from a collapsed state; they each comprise a base, a pair of backstays pivoted to one end of the base, and a pair of beam columns pivoted to the other end of the base, the backstays and beam columns being at small, acute angles to the plane of the base in the collapsed position, and being erected to form a triangle in the use position. Connecting means at the free ends of the backstays and beam columns are automatically engaged upon erection. A pair of reaction beams each has one end pivoted to a beam column, intermediate its ends, and extends over the base and past the one end of the base: anchoring means anchor the reaction beams to the ground. The reaction beams have inwardly extending haunches, which form between them and the base a passage for the deck units.

Each deck unit comprises a pair of spaced upper longitudinally extending bars connected to a pair of lower such bars, with all bars parallel. A bearing element extends transversely through the deck unit intermediate its ends, the dimensions of the deck unit and abutment being such that the bearing element engages the bottoms of the haunches of the reaction beam, as the deck unit is pushed through the passage of the abutment. The deck units have coupling means at their ends, to connect them end to end.

43 Claims, 20 Drawing Figures

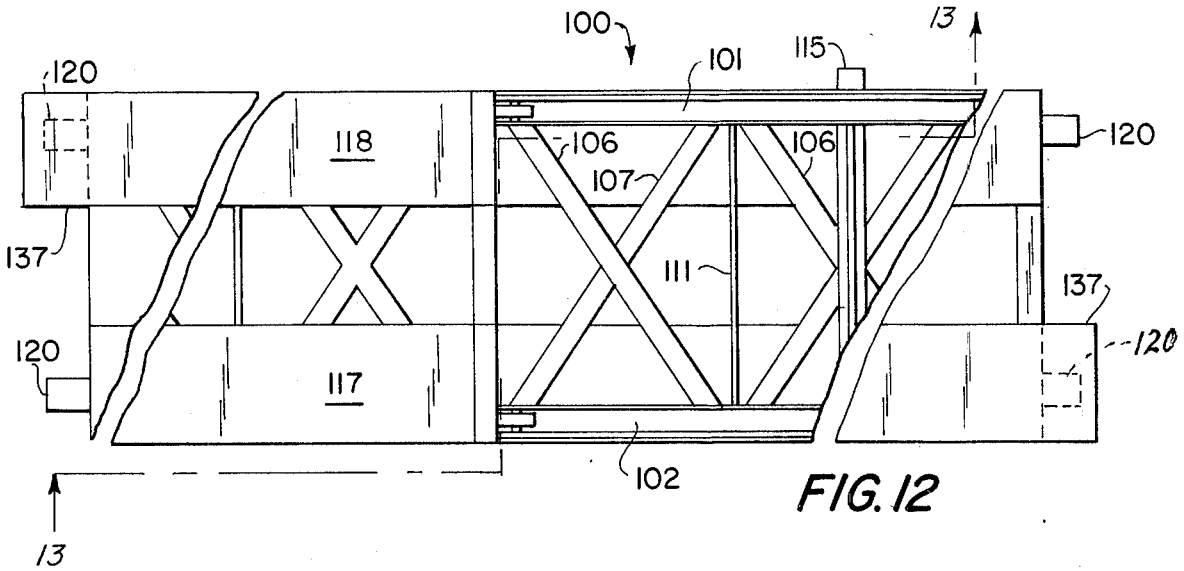
FIG. 12
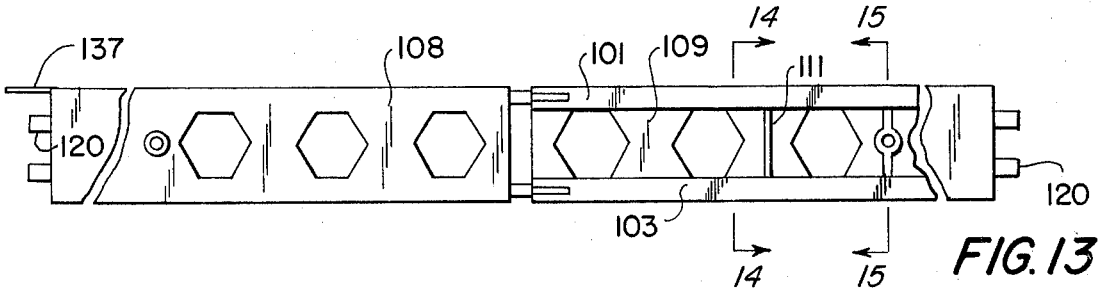
FIG. 13
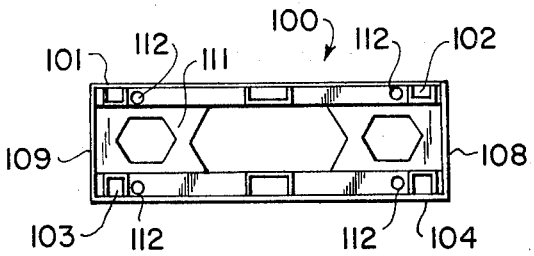
FIG. 14
FIG. 15
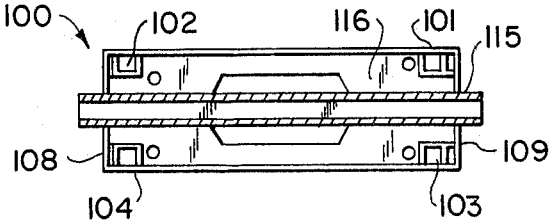

TRANSPORTABLE BRIDGE AND METHOD

A method of erecting a transportable bridge comprises transporting in collapsed condition a pair of bridge abutments each comprising a base and elements pivotally joined to the base, and a plurality of elongate deck units. A first abutement is erected on and anchored to one bank of a depression, forming a passage through the abutment. The deck units are connected end to end, and are pushed through the abutment, extending over the depression. The deck units are supported by engagement with elements of the abutment structure, and by cables extending from the abutment and connected to one of the deck units. The deck units are passed through the first abutment into engagement with the opposite bank. Then the second abutment is transported through the first abutment and over the connected deck units to the opposite bank. The second abutment is then erected on and anchored to the opposite bank, and the deck units are hoisted into position for passing through the second abutment by the cables extending from the first or second abutment and connected to one of the deck units, so that the deck units form a complete and continuous deck across the depression, supported by the two abutments.

BACKGROUND OF THE INVENTION

The present invention pertains to bridges, and more particularly to bridges which may be transported by road vehicles, and erected at the site.

Transportable bridges have been developed over the years, particularly in connection with the movement of armies during warfare. The need has increased, as the mobility of the armies has increased. Such needs, ever expanding, are for improved transportability, the ability to be easily and quickly erected, the ability to span over larger depressions, such as ravines and streams and rivers, and the ability to carry larger loads.

Among the developments in the arts of transportable bridges there may be mentioned a bridge comprising sections made of structural members, relatively elongate, and having a top, a bottom and a pair of connecting sides, so as to provide a somewhat tubular section of substantially square cross section. An abutment section was provided, somewhat in the nature of a semi-trailer, equipped near one end with a set of wheels, and near its other end with a coupling for attachment to the "fifth wheel" of a tractor vehicle. This first section served as an abutment and upon arrival at the site, jacks were lowered to support the section, the tractor was disconnected, and the wheels of the section were elevated. Additional sections were provided, which could be telescoped within the first mentioned section, and these were joined end to end, and pushed through the first or main supporting section. The secondary sections, connected end to end, upon being pushed through the main section, provided a substantial weight cantilevered outwardly and over the depression, being supported only by the first or main section. To counterbalance this weight, additional sections were added, so that there was substantially the same number of sections to counterbalance as there were sections extending over the depression. In that way, substantially twice as many sections were required as were needed to span the depression. In addition, such prior art bridge could not span very wide depressions, nor could it carry very great loads. When in place, it had no abutment, merely the provision of the end sections of the bridge resting upon the two banks of the depression.

In another suggestion in the prior art, generally similar, many of the bridge sections were provided with wheels, so that the entire bridge was moved by a tractor vehicle, after the sections had been assembled end to end, so that an extending end of the bridge made up of the connected sections would be pushed out over the depression, with the leading end eventually engaging the bank on the opposite side of the depression. In this construction, also, the bridge was constructed so as to have a length double that of the depression to be crossed, the additional sections of the bridge serving to counterbalance the sections extending over the depression. Thus, this prior art suggestion, also, required twice as many sections as was needed, could only span depressions of limited extent, and could not carry heavy loads.

The well known Bailey bridge, extensively used by the U.S. Army during World War II, while transportable, required a substantial crew to erect it and was limited in its load carrying capacity.

Other developments in the art of military bridging includes the scissors bridges, mounted on vehicles. These, too, could only be used to span depressions which were relatively narrow, and did not have great load carrying ability.

SUMMARY OF THE INVENTION

The present subject matter is directed to a transportable bridge, and to a method of erecting it. The bridge is comprised of a pair of substantially identical abutments, and a plurality of deck units. The abutments are transportable in a collapsed state, comprising a generally rectangular base, with a pair of backstays each pivoted to one end of the base, on either side thereof. A pair of beam columns are pivoted to the other end of the base, one on either side thereof. When collapsed for transport, the backstays and beam columns lie over the base, and extend at small, acute angles to the plane of the base thereby providing a transport condition of the abutment having a relatively low height. When erected, the base, beam columns and backstays provide a triangular configuration, in elevation. Connecting means are provided at the free ends of the backstays and the beam columns, specifically in the form of a downwardly facing hook at the end of the backstays, and an outwardly extending pin at the free ends of the beam columns, thereby providing for engaging connection between the free ends of the backstays and beam columns.

To this generally triangular abutment structure, there is additionally provided a pair of reaction beams, each of which has one end pivotally connected to a beam column, at a point somewhat above the base unit in the erected condition, the reaction beams extending over the entire base unit, and beyond the end to which the backstays are connected. Earth anchors engage the free ends of the reaction beams, to anchor them, and through them, the entire abutment. Alternatively, a heavy weight, such as a vehicle, may be placed on the reaction beams, for anchoring the abutment. The reaction beams are provided with inwardly extending haunches, which form between them and the base of the abutment a passage, so that deck units may be passed through this passage.

The beam columns each includes a lower portion which is outwardly of either side of the base, an upper portion inwardly offset from the lower portion, and a transverse connecting portion, the reaction beam being pivotally connected to the beam column above the connecting portion. The bottom surface of the transverse portion of the beam columns serves as a reaction surface for the deck units, defining with the base a portion of the passage for the deck units. The beam columns are provided with deck support plates extending generally forwardly of the base, when the abutment is erected, to provide further support for the deck unit as it is pushed through and outwardly of the abutment. The lower portions of the beam columns support extendable legs for the abutment, these lower portions being hollow, with the extendable legs and hydraulic motors, or long-stroke piston rams, for moving them being therewithin.

A deck unit has two spaced upper and two spaced lower bars, which are longitudinally extending and parallel to each other, the bars being connected by a suitable framework. A bearing element is provided, extending transversely through the deck unit, intermediate its ends, this bearing element being engageable with the haunches and the transverse portion of the beam column for reactive engagement therewith, and the bearing elements also being engageable by cables extending along the backstays, from their lower portions upwardly, and thence downwardly, to engage the bearing element of one or more of the deck units. The deck units are provided with coupling means at their ends, so that they may be connected in end-to-end relationship.

The invention provides a method of erecting a transportable bridge, which comprises the transporting of an erectable abutment in collapsed condition, and the anchoring of the abutment on an accessible bank of a depression. The erection is performed by rotating elements pivotally connected to a base. When erected, the abutment is anchored, and provides a passage for deck units. Deck units are connected end-to-end, and are pushed through the abutment, extending out over the depression. Suspension cables may be provided for giving support to the deck units, extending over the uppermost portion of the erected abutment, and thence downwardly. The deck units are pushed through the erected abutment, until the leading deck unit engages the opposite bank. Then, a second abutment, in collapsed condition, is transported through the first abutment and over the bridge structure provided by the deck units, and is erected on the opposite bank, anchored, and used to support the deck provided by the deck units.

Among the objects of the present invention are the provision of a transportable bridge which may be erected from one bank of a depression, and which is capable of spanning a relatively wide depression, for example, a depression of substantially 150 feet.

Another object is the provision of a transportable bridge which will permit the erection of the bridge and the spanning of a relatively wide depression, even while the erecting party is under hostile fire.

Yet another object of the present invention is to provide a transportable bridge which is capable of carrying heavy loads, after erection from access to one bank only.

Yet another object of the present invention is the provision of a transportable bridge which includes an abutment having a low collapsed height.

A further object of the present invention is to provide an abutment for a transportable bridge which may be quickly erected, and erected from collapsed condition, without requiring personnel to climb to high, exposed places.

A still further object of the present invention is the provision of an abutment for a transportable bridge which may be erected by manipulation of parts by personnel in relatively unexposed positions, so as to avoid casualties due to enemy fire directed from the opposite bank.

Yet another object of the present invention is the provision of an abutment for a transportable bridge which may be readily anchored in position, as by vehicle weight or ground anchor.

Yet another object of the present invention is to provide an abutment for a transportable bridge which is collapsible, having a relatively low height, and which may be erected to provide a passage therethrough for deck units.

A further object of the present invention is to provide an abutment for a transportable bridge, which abutment is collapsible, and which abutment when erected provides a lower support and an upper reaction surface for deck units of the bridge.

A further object of the present invention is the provision of an abutment for a transportable bridge which is erectable on site, and which is useable even through the terrain is rough and uneven.

A still further object of the present invention is to provide an abutment for a transportable bridge having hydraulic motors for extending supporting legs, which hydraulic motors are protected from hostile fire.

Another object of the present invention is to provide a deck unit for a transportable bridge which is strong, and which may be reinforced by pretensioning or post-tensioning cables through the deck units.

Yet another object of the present invention is the provision of a deck unit for a transportable bridge having bearings for engaging a bridge abutment, and for support by suspension cables of the abutment.

Another object of the present invention is the provision of a method for erecting a transportable bridge, where access is provided to only one bank of a depression, without requiring the provision of excess units of the bridge, as for counterbalancing, which permits rapid erection of the bridge, with minimum exposure of the erecting party to hostile fire, and which permits the erection of a bridge capable of spanning a relatively large depression.

Other objects and many of the attendant advantages will be perceived from the following specification, drawings and claims.

BRIEF DESCRIPTION OF THE DRAWINGS

FIG. 12 is a plan view with parts removed of a deck unit in accordance with the present invention.

FIG. 13 is a view taken along the line 13—13 of FIG. 12.

FIG. 14 is a view taken on the line 14—14 of FIG. 13.

FIG. 15 is a view taken on the line 15—15 of FIG. 13.

DESCRIPTION OF THE PREFERRED EMBODIMENT

Figure 1:
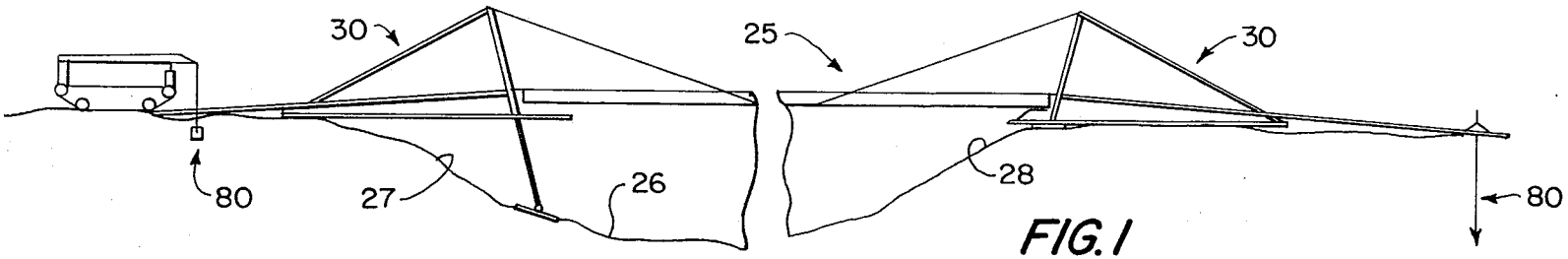
FIG. 1 is an elevational view of a transportable bridge in accordance with the present invention, erected across a depression.

Referring now to the drawings, wherein like or corresponding reference numerals are used for like or corresponding parts throughout the several views, there is shown in FIG. 1 a transportable bridge generally designated 25, for use in spanning a depression 26, which may be either a ravine, or a body of water such as a river. As is oftentimes encountered, the site of the bridge differs on one bank from that of the other, so that the variations in the topography must be accommodated in the construction of the bridge 25. More particularly, the left bank or site 27 is gently sloping, while the right bank 28 will be seen to be more precipitous, providing a generally level surface, followed by a rather steep decline into the depression 26.

On the right and left banks there have been erected the abutments 30 of the transportable bridge 25, these abutments serving to support a series of deck units (to be hereinbelow discussed) and being anchored by suitable anchoring devices or elements, also to be hereinbelow discussed.

Figure 2:
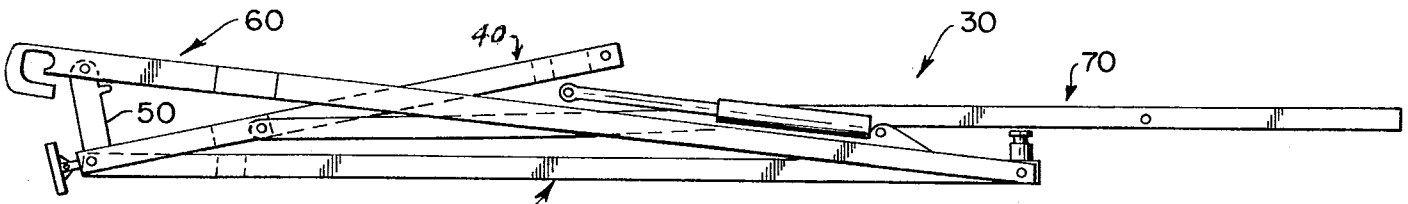
FIG. 2 is an elevational view of an abutment forming a part of the bridge of the present invention, in collapsed condition.

Referring now to FIG. 2, the abutment 30 is shown in its generally collapsed state, for transport. The abutment comprises a base generally designated 31, a beam column 40 which is pivotally connected at one end of the base, a backstay 60 pivotally connected to the other end of the base, and a reaction beam 70 which is pivotally connected to an intermediate point on the beam column 40, and which extends over the base 31, and beyond the end of the base 31 to which the backstay 60 is pivotally connected. The beam column 40 overlies the base 31 at an acute angle, as does the backstay 60. As a result, the entire abutment 30 in the collapsed state shown in FIG. 2 has a low height above the base 31, so that it is relatively compact for transport.

Figure 3:
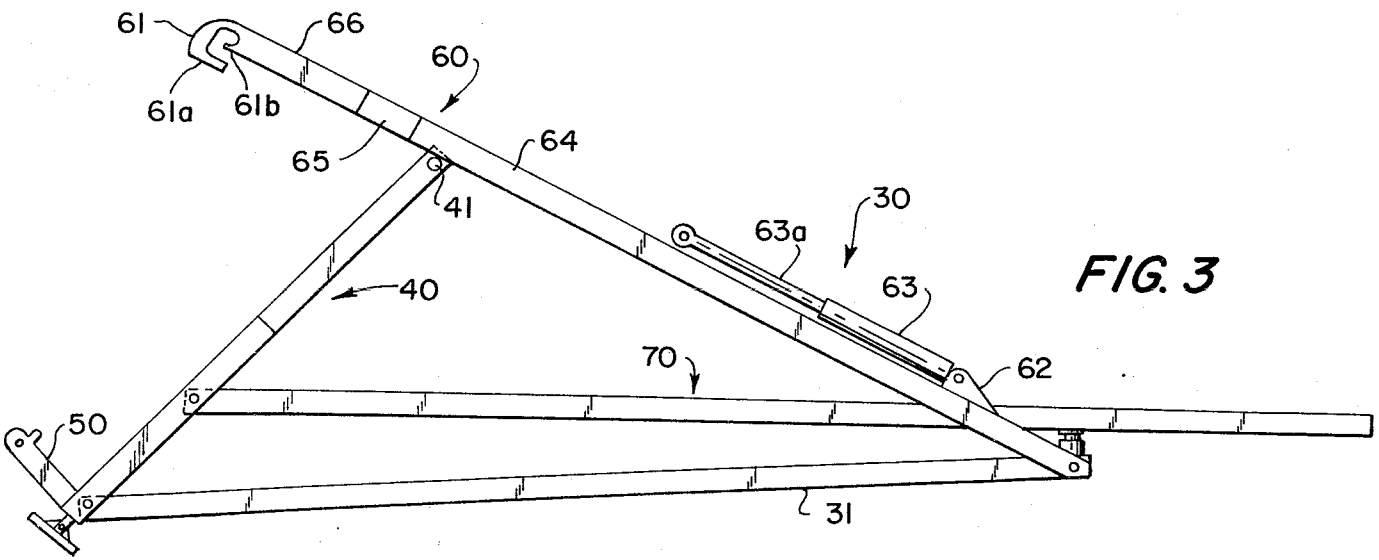
FIG. 3 is an elevational view of the abutment of FIG. 2, and showing the abutment in partially erected condition.

FIG. 3 shows the abutment 30 during the initial stage of erection. The backstay 60 has been rotated in a clockwise direction about its pivotal connection with the base 31, so as to elevate the left, free end thereof, and the beam column 40 has been rotated in a counter-clockwise direction about the pivotal connection thereof with the base 31, its outer, free end also being substantially elevated. At its free end, the backstay 60 is provided with a downwardly facing hook 61 having a rearwardly directed bottom portion 61*a* going generally in the direction of the pivotal connection of the backstay 60, providing an entry facing to the right and downwardly. This configuration is provided to receive and retain pin 41 which extends outwardly from the upper end of the beam column 40. A mounting pad 62 is provided on the upper surface of the backstay 60; pivoted to and lying forwardly of it is a hydraulic motor 63 having an extending piston 63*a*, used for stressing a cable, to be referred to hereinbelow.

Figure 4:
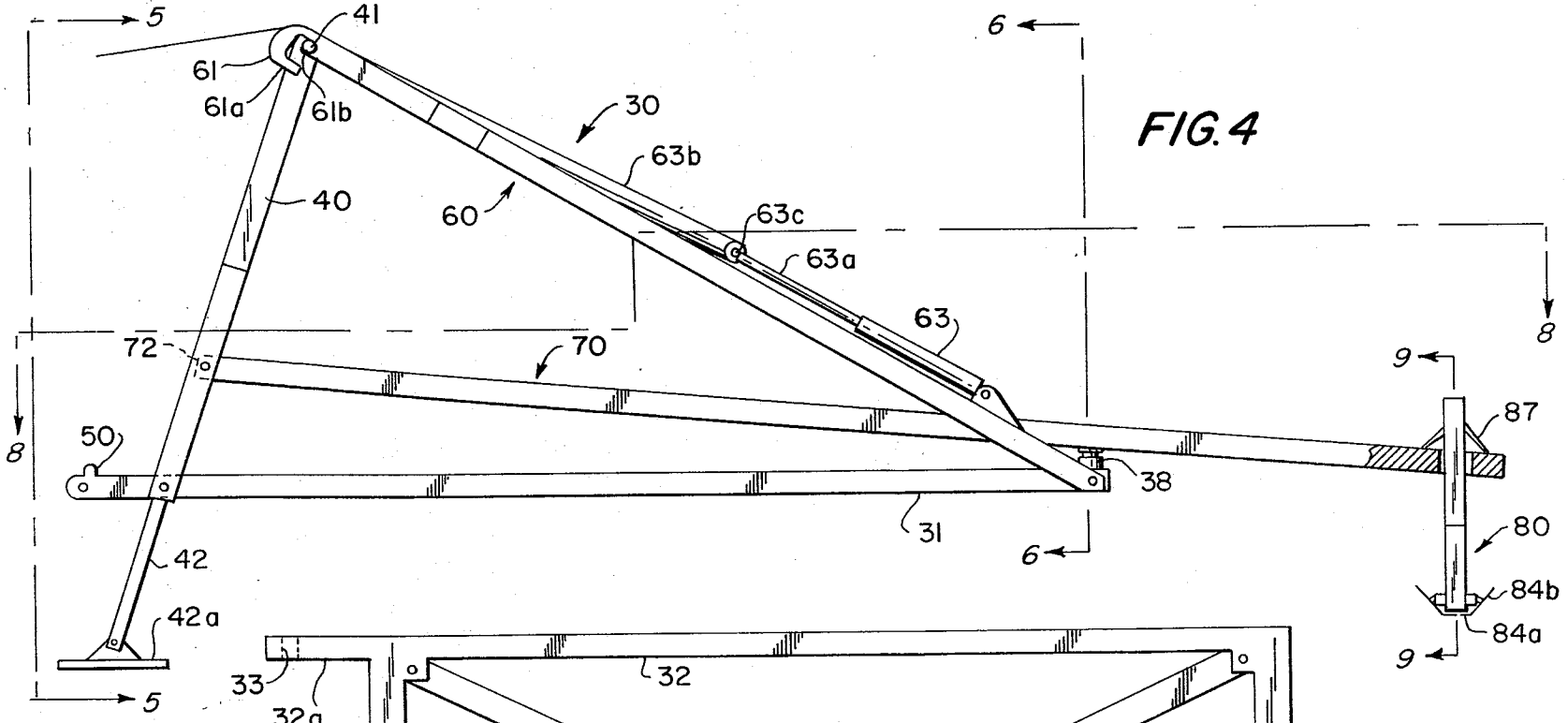
FIG. 4 is an elevational view similar to FIG. 3, but showing the abutment in fully erected condition.

Referring now to FIG. 4, there will be seen the abutment 30 in fully erected state or condition. The pin 41 of the beam column 40 has entered into the hook 61, passing into the rearwardly and downwardly directed entry, and then lying upon the retention extension 61*b*. This permits the erection of the beam column 40 and the backstay 60 by manipulation from lower positions close to the ground. The beam column 40 is thereby releasably connected to the backstay 60, without the necessity for a member of the working party to proceed to the high point or apex of the abutment 30, in order to make the connection between the beam column 40 and the backstay 60. Thus, the abutement 30, of generally triangular shape, may be erected quickly, and without exposing members of the working party to hostile enemy fire, as would be the case if they had to work in an elevated, exposed position. Also in FIG. 4 there will be seen the supporting suspension cable 63*b* which is anchored to the backstay 60, extends around a sheave 63*c* that is carried by the piston 63*a*, and thence over the apex of the abutment 30.

At its lower end, the beam column 40 has extending from it extendable legs 42 pivotally carrying at their lower ends pads or feet 42*a*.

Figure 5:
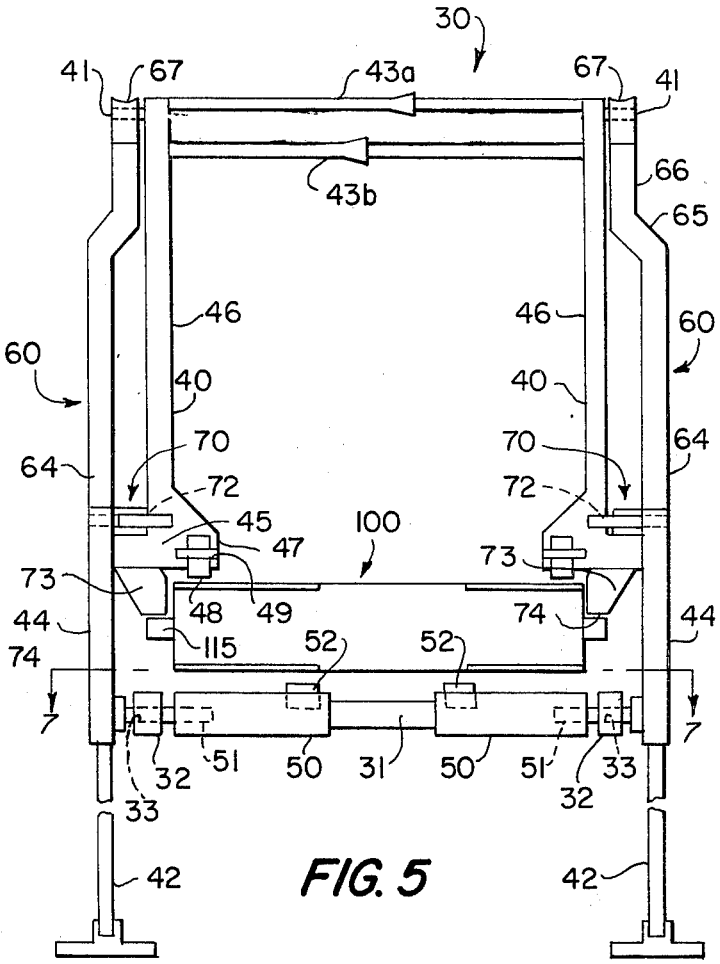
FIG. 5 is a view taken on the line 5—5 of FIG. 4.

Referring now to FIG. 5, there is shown a front elevational view of the abutment 30. The base 31 is shown, extending horizontally, and as is clearly apparent, there are a pair of beam columns 40, of identical construction but of subtantially mirror images to each other, and these are pivoted on the outside of the base 31. Outwardly of the upper ends of the beam columns 40 may be seen the backstays 60, which are also located on either side, respectively, of the base 31.

At the upper ends of the beam columns 40 there may be seen the outwardly extending locking pins 41. The pins extend outwardly so that their ends lie substantially in the plane of the outer surface of the backstays 60 at their upper ends. The backstays 60 may be seen to be dog-legged, having lower portions 64 which are relatively wider spread, and upper portions 66 which are less widely spread or spaced apart, with an intermediate connecting inclined portion 65. By this construction, and referring now to FIGS. 2 and 3, during erection of the abutment 30, the backstays 60 are first rotated to approximately the position shown in FIG. 3, and then the beam columns are rotated upwardly, so that with a few additional degrees of counterclockwise rotation of the beam columns 40, the pins 41 may begin to engage the upper portion 66 such that continued counterclockwide rotation causes the pins 41 to carry the backstay 60 upward coincident with the movement of the beam columns 40. Also, at about that point, there could be applied a generally axial force on the reaction beams 70, to thereby cause further rotation of the beam columns 40, with reversal of the axial directional force on the reaction beams 70 once the pin 41 has passed through the entry of the hook 61, so that it is retracted into the position above the retention extension 61*b*.

Referring again to FIG. 5, the upper ends of the backstays 60 are provided with seats 67, which serve as guides for the cables 63*b* (not shown in FIG. 5 for purposes of clarity).

A bracing structure is provided at the top of the beam columns 40, to connect the two beam columns 40 to each other. This connecting structure includes an upper telescopic member 43*a* and a lower telescopic member 43*b*. Each of these telescopic members is made up of a pair of members, each connected at an end to one of the beam columns 40, and one extending into the other in a telescopic manner. This construction permits, together with other structure to be hereinbelow described, lateral collapsing of the entire abutment 30 for transport, and its lateral extension when erected for use.

The beam columns 40 each comprise a lower portion 44, the two lower portions being relatively widely spaced, and the beam columns also comprise upper portions 46, which are more closely spaced. Thus, the upper portions 46 of the beam columns 40 lie just inwardly of the upper portions 66 of the backstays 60. The lower portions 44, however, lie in substantially the same plane as the lower portions 64 of the backstays 60. These planes are just outwardly of the outer surfaces of the base 31. The lower portion 44 of each of the beam columns 40 is connected to the inwardly offset upper portions 46 thereof by a transverse connection portion 45. The reaction beams 70 are connected to the beam columns 40 just above the connecting portion 45, by a pin 72. As may be seen in FIG. 5, the upper end of the lower portion 44 extends above the pin 72 and the connecting portion 45, so that the forward end of the reaction beam 70 lies between the upper extremity of the lower portion 44 and the lower extremity of the upper portion 46 of the beam column 40. As shown, the pin 72 may extend not only through the upper portion 46 and the reaction beam 70, but also through the lower portion 44 of the beam column 40. The transverse portion 45 extends inwardly, beyond the upper portions 46 of the beam columns 40, and overlie the base 31, the lower or bottom surfaces of the connecting portions 45 being spaced above the base 31 a distance sufficient to permit passage of a deck unit 100 therebetween. The inward extensions of the connecting portions 45 are designated 47, and each of them is provided with a recess in which there is supported a roller 48, carried by a pin 49. This provides an anti-friction device on each beam column 40 for engaging the upper surface of a deck unit 100 when the deck units are fed through the passage formed between the base 31 and the connecting portion 45 and extension 47 thereof of the beam columns 40.

The reaction beams 70 have inwardly directed and extending haunch portion 73, the haunches 73 also being spaced above the base 31, to also provide a portion of the passage through which the deck units 100 move. The haunches 73 may be seen to provide a downwardly facing guiding surface 74.

The base 31 comprises a pair of transversely spaced beams 32, shown in end view in FIG. 5. The lower portions 44 of the beam columns are each provided with inwardly extending axles 51, which extend through apertures 33 in the beams 32. These axles 51 each carry a deck support plate (see also FIGS. 2–4), each of which has a roller 52 in the upper surface thereof. The rollers 52 provide an anti-friction support for the deck units 100, and form with the deck support plates 50 a portion of the passage for the deck units 100. The beam columns 40, axles 51 and deck support plates 50 rotate as a unit, journalled in the aperture 33 of the beams 32 of base 31.

Figure 6:
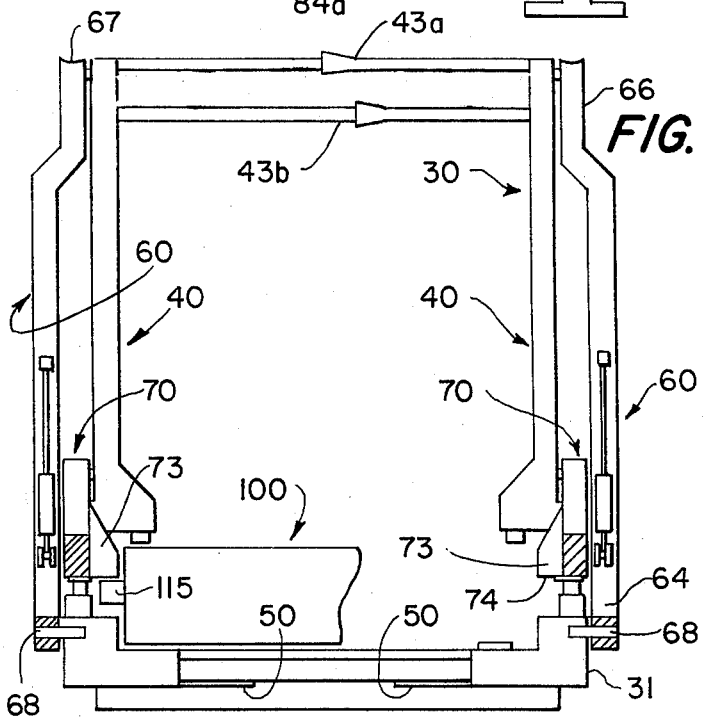
FIG. 6 is a cross sectional view taken on the line 6—6 of FIG. 4.

Referring now to FIG. 6, there may be seen the deck unit 100, partially broken away, with abutment 30 including the backstays 60 and the beam columns 40. The reaction beams 70 may be seen, with their haunches 73, and downwardly facing guiding surfaces 74. The backstays 60 may be seen to be connected to the base 31 by pivot pins 68. The lower portions 64 of the backstays 60 will be seen to lie just outwardly of the outside of the base unit 31, and thus are in the same plane as the lower portions of the beam columns 40, which are not seen in FIG. 6.

Figure 7:
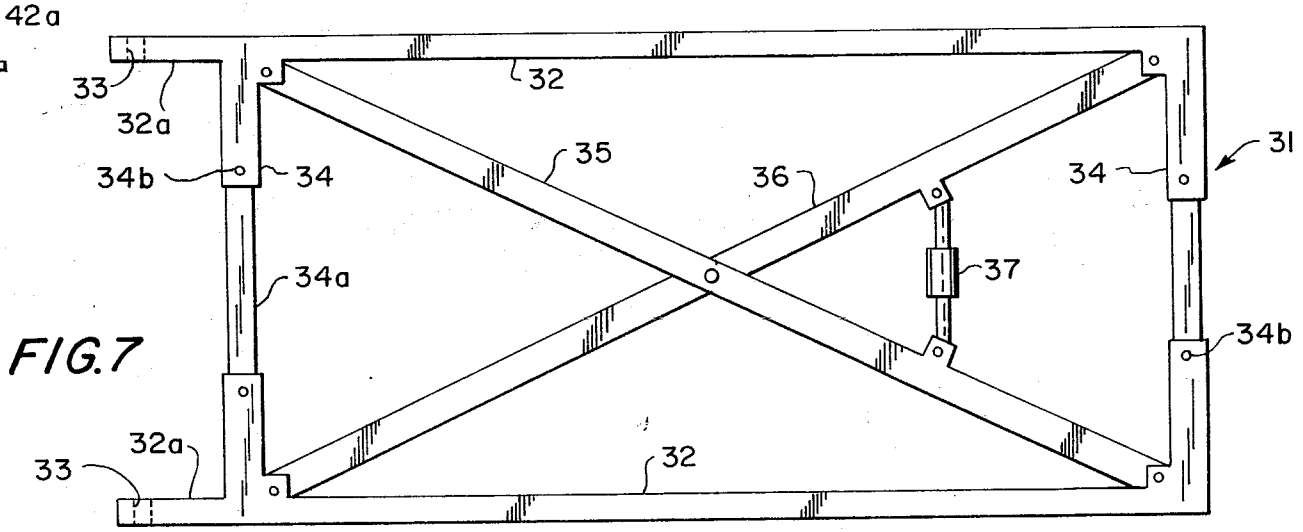
FIG. 7 is a view of the base of the abutment, taken generally on the line 7—7 of FIG. 5.

Referring now to FIG. 7, there is shown in plan view the base 31, which may be seen to include the beams 32 at either side thereof, together with transverse telescopic beams 34. These comprise tubular members which are connected to or form a part of the longitudinally extending beams 32, together with a bar portion 34*a* which extends into and connects the transverse telescopic member 34. Pins such as are shown at 34*b* are provided to lock the bar 34*a* in place. Two diagonally extending members 35 and 36 are pivotally connected to each other, and to the frame made up of the beams 32 and the transverse telescopic beams 34. A hydraulic motor 37 is provided for moving the diagonal members 35 and 36 relative to each other, to increase and decrease the width of the base 31. As will be apparent, the width is decreased for transport, and then the base unit is transversely expanded, into its use position. Such transverse width adjustment is permitted, also, by the upper and lower telescopic members 43*a* and 43*b* which connect the beam columns 40 at their upper ends. FIG. 7 shows that while the base 31 is generally rectangular, the beams 32 at the sides thereof extend somewhat forwardly of the transverse telescopic beam 34 at the front, to provide extensions 32*a* and it is in these extensions that the apertures 33, referred to above, are located.

Figure 8:
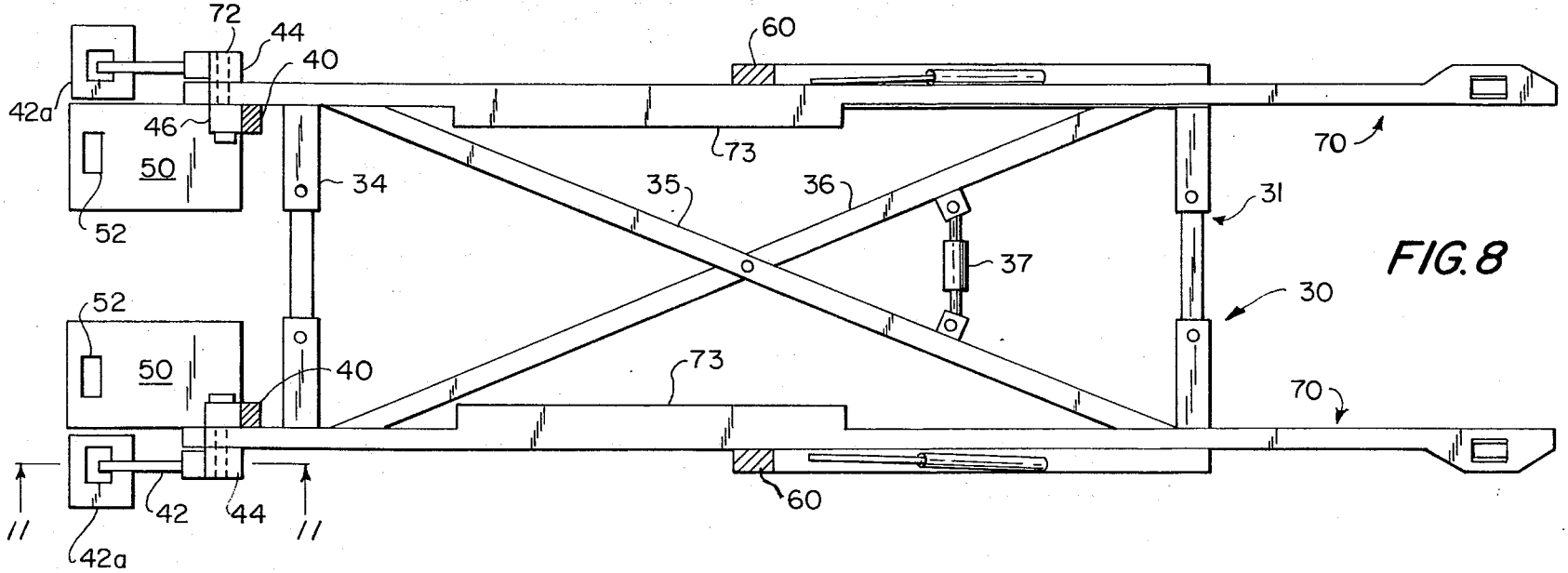
FIG. 8 is a cross sectional view taken on the line 8—8 of FIG. 4.

FIG. 8 shows the abutment 30 including the base unit 31 with the diagonal members 35 and 36, and the hydraulic expanding and contracting motor 37. There is also shown the reaction beam 70, connected by the pivot pin 72 to the beam column 40, and there may also be seen the inwardly extending haunches 73 of reaction beam 70. Further, there are shown the deck support plates 50 with their rollers 52, and the extendable legs 42 having the pads 42*a* at the lower ends thereof.

Figure 10:
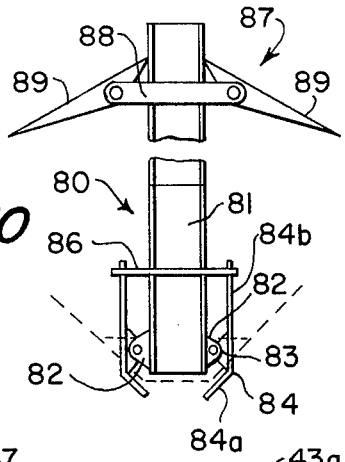
FIG. 10 is a view taken on the line 10—10 of FIG. 9.
Figure 9:
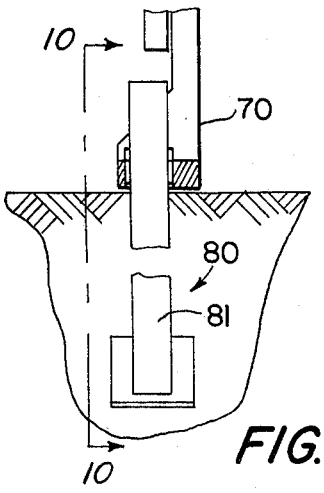
FIG. 9 is a cross sectional view taken on the line 9—9 of FIG. 4.

Referring now to FIGS. 9 and 10, there may be seen the anchors 80 for the reaction beams 70, these anchors 80 including a generally vertically extending shaft 81 that is preferably in the form of an I-beam. At its lower end, on opposite sides thereof, the shaft 81 is provided with outstanding ears 82. Preferably, the ears 82 are formed as parallel, spaced apart ears, there being a pair on each side of the shaft 81. Between the ears 82, on each side, is a lug 83, connected to the ears by a pivot pin extending through them, the pivot pins lying horizontally. The lugs 83 are connected to spades 84 having a lower plate 84*a* and an upper plate 84*b*. A securing member 86 extends around the upper ends of the upper plates 84*b*, to hold the upper plates 84*b* of spades 84 in positions which are generally vertical, the lower plates 84*a* extending downwardly, and towards each other. A retainer generally designated 87 is provided on the upper end of the shaft 81, after installation of the anchor 80 and its positioning relative to the reaction beam 70 as shown in FIG. 9, and this retainer is comprised of a pair of parallel bars 88 extending on either side of the shaft 81, between the ends of which are connected the shaft grippers 89. These are put in position after the assemblage of the reaction beam 70 and shaft 80 in the position shown in FIG. 9, so that any upward movement or force generated by the reaction beam 70 on the outer ends of the grippers 89 causes the inner ends of the grippers 89 to engage with the shaft 81, and to tighten their grip thereon, thereby resisting upward movement of the ends of the reaction beams 70 which are remote from the beam columns 40.

The opened or retaining position of the spades 84 is shown in FIG. 4, wherein it may be seen that the lower plates 84*a* lie in substantially the same horizontal plane, while the upper plate 84*b* thereof is outwardly inclinded, so as to provide the resistance of upward movement of the anchor 80. It will be recognized that the securing member 86 will have been released or removed from the spade 84 in order to permit the noted movement from the position shown in FIGS. 9 and 10 on the one hand, to the position shown in FIG. 4 on the other hand.

This removal is accomplished when the spade slides through the soil into which it is driven. The inward pressure of the soil during the downward movement of the shaft 80 as it penetrates the soil keeps the spades 84 closed. The spades 84 automatically open to resist withdrawal. The shaft 80 may be left in place when the bridge is removed if withdrawal proves too difficult.

Figure 11:
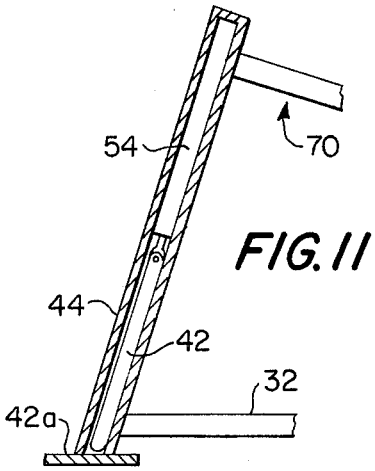
FIG. 11 is a cross sectional view taken on the line 11—11 of FIG. 8.

FIG. 11 shows the lower portion 44 of the beam column 40, the lower portion being hollow as shown, and including a hydraulic motor 54 to which the extendable leg 42 is attached. When desired, and as is indicated in the left hand abutment of FIG. 1, the hydraulic motor 54 may be actuated so as to extend the extendable leg 42, so that the pad 42*a* may rest upon the surface of the depression which is bridged by the transportable bridge 25 as herein disclosed. The housing of the hydraulic motor 54 within the hollow lower portion 44 provides for protection of the apparatus for extending the extendable legs 42 from hostile fire. The pad 42*a* may be provided with a breakaway connection with extension leg 42 so that the leg 42 may be more easily withdrawn upon removal of the bridge.

FIG. 12 is a plan view, with parts removed, of a deck unit 100 in accordance with the present invention. There are provided a pair of upper parallel longitudinally extending generally box shaped bars 101 and 102 which are in spaced apart relationship as shown. In FIG. 14, there may be seen these upper bars 101 and 102, and a pair of spaced apart, parallel lower, generally box shaped bars 103 and 104, the four bars being parallel to each other. The four bars are connected by cross members or diagonals 106 and 107, to provide a strong deck unit which is relatively long, thin and flat, with suitable width. Reinforcement and interconnection of the units is also provided by the side plates 108 shown in FIG. 13, thus connecting the bars 102 and 104, while as shown in FIGS. 13 and 14, a side plate 109 connects the bars 101 and 103. There are also provided transverse stiffening diaphragms 111 which extend to and are connected with all of the bars 101–104, the stiffening diaphragms 111 having openings 112 therein for the reception of cables which extend generally longitudinally. These may be either pre-tensioned or post-tensioned, in order to add strength to the deck units 100.

The deck units 100 are also provided with bearings 115 which extend transversely through the deck units, being generally in the form of a tube, the tube itself being joined to a transverse plate 116, as shown in FIGS. 13 and 15. The lateral extension of the bearing members 115 beyond the side plates 109 and 108 is clearly shown in FIG. 15.

Referring again to FIG. 12, it may be seen that, as shown at the left hand side of the deck unit 100, there are provided a pair of surface plates 117 and 118, so as to provide a suitable support for vehicles or personnel in order to permit them to cross the transportable bridge 25 when it has been completed.

The deck units 100 are provided with couplers 120, at the ends thereof, these being generally in the form of the kind of couplers frequently used in connection with railroad rolling stock, so that relative axial movement, with proper alignment, will result in engagement and holding of one coupler to the other. Cover plates 137 for the couplers 120 are provided by extending the surface plates 117 and 118. These cover plates protect the couplers from excessive dirt contamination, but more importantly, act as shelves to prevent the vertical displacement of the deck units 100 in the coupling 120.

Figure 16:
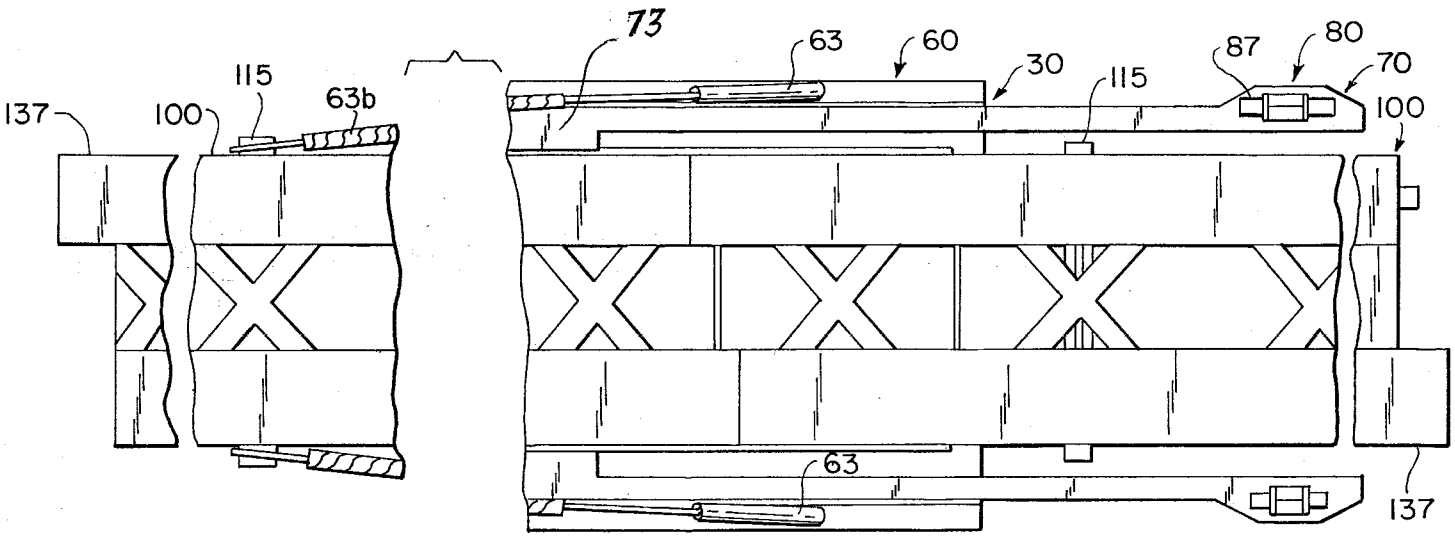
FIG. 16 is a plan view, with parts removed, of deck units associated with an abutment.

Referring to FIG. 16, there may be seen the assemblage of deck units 100 with the abutment 30. Of particular interest in the showing in FIG. 16 are extending bearing members 115, which will be seen to be dimensioned so that they will extend beneath the haunches 73, thereby further providing indications of the cooperative relationship between the haunches 73 and the bearings 115, as shown in FIGS. 5 and 6. Further, the motors 63 are shown, positioned on the backstays 60, with the cables 63*b* extending from them, the cables being secured to the bearings 115 on a leading deck unit 100. This arrangement provides support for the deck units as they are pushed outwardly of the abutment 30. The cables may be attached to the leading deck unit if the depression to be crossed is relatively small, but will be connected instead to one of the more intermediate units if necessary to obtain a more desirable mechanical advantage for support.

Figure 17:
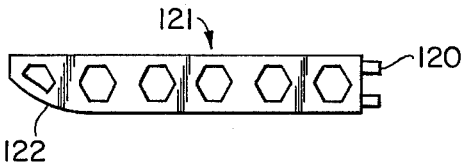
FIG. 17 is an elevational view of a nose portion attachable to a leading deck unit.
Figure 18:
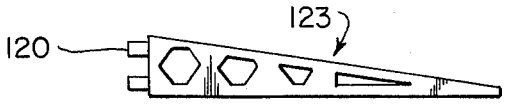
FIG. 18 is an elevational view of a ramp unit attachable to a deck unit.

In FIG. 17 there is shown a nose unit 121 which may be connected to the leading deck unit 100, as by the couplers. This nose unit 121 is generally similar to a deck unit 100, except that it is characterized by a curved and upwardly inclined lower leading edge surface 122, so that it may engage and ride up on an opposite bank. In FIG. 18 there is shown a ramp generally designated 123, also provided with couplers 120, and having a view in elevation, as shown, to permit riding up onto the deck units by vehicles, in a convenient manner.

Figure 19:
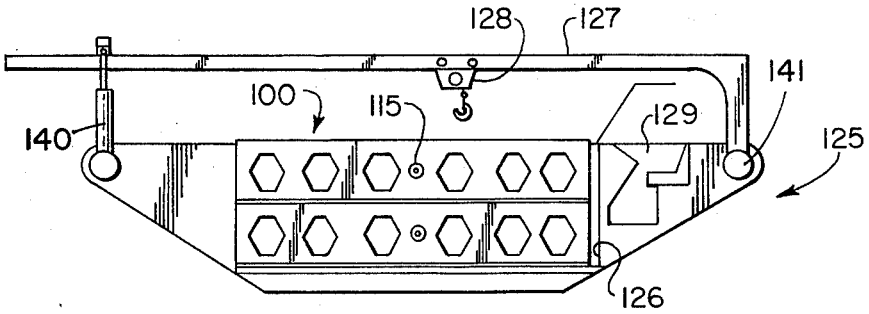
FIG. 19 is an elevational view of a carrier vehicle, with crane, for transporting and off-loading deck units.

FIG. 19 discloses a vehicle 125 which may be used to transport a plurality of deck units 100, there being shown two deck units 100 stacked one on top of the other, generally in the well 16 of the vehicle 125. This vehicle is provided with a boom 127 and a travelling hoist 128 which is used for off-loading the deck units 100. In addition, there is provided an operator's compartment 129. The vehicle 125 may be tracked vehicle, the showing being generally schematic. Boom 127 pivots about point 141. This allows for the hydraulic motors 140 to better position boom 127 during the loading, unloading and hauling phase, but more importantly, the hydraulic motors 140 can be used to exert a downward force on the anchor 80 when an anchor 80 is installed.

Figure 20:
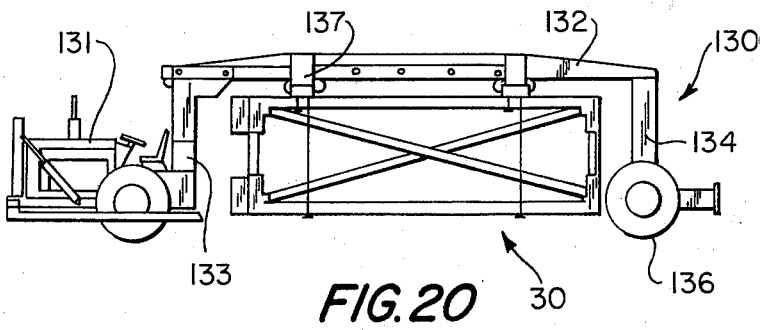
FIG. 20 is a view of a special vehicle for transporting an abutment.

FIG. 20 discloses in elevation a vehicle 130 for transporting the abutment 30, and is characterized by a tractor 131, and a chassis including an upper beam or beams 132 extending rearwardly from a post 133 provided at the back of the tractor 131, and to a rear post 134 which is supported and carried by the rear wheels 136. Suitable handling devices 137 are provided on the beam or beams 132 to support and permit off-loading of the abutment 30.

There will be as many of the vehicles 125 provided as is required to transport the deck units 100 necessary to cross a depression that is likely to be encountered, and there may be provided two of the vehicles 130, one for each of the abutments 30.

In operation, once the desired site has been selected, on one bank or side of a depression, erection of the first abutment 30 may be begun, even though the opposite bank of the depression is occupied by hostile forces. The first abutment 30 is off-loaded from the vehicle 130, moved into the desired position, and is then laterally expanded, as by operation of the motor 37 of the base 31. The abutment 30 is then in the state generally shown in FIG. 2, which is the collapsed condition or state thereof, and is then erected to the position shown in FIG. 4, by the procedures hereinabove set forth. The anchors 80 are set in position, as shown in FIG. 4. Jacks 38 may be provided beneath the reaction beams 70, and supported on the base 31, for providing a stress on the reaction beam and to aid in leveling base 31.

The deck units 100, having been off-loaded from the vehicles 125, and, optionally, having had a unit 121 placed at the lead thereof, are coupled together in line by engagement of the couplers 120, thereby forming a series or train of deck units 100. These are caused to be pushed in the passage through the abutment 30, with the bearings 115 reacting against the haunches 73, and with the upper surfaces of the deck units being in engagement with the rollers 48 and the lower surfaces in engagement with the rollers 52. The deck support plates 50 provide for support for the generally cantilevered deck unit 100, or a portion thereof, which is in the lead of the train or series of deck units 100, somewhat further outwardly than would otherwise be provided. In addition, the cables **63*b* may be attached to the bearings 115 of either the leading or an intermediate deck unit 100, so as to provide support for them, as they are pushed outwardly by continual feeding and pushing of subsequent deck units 100 into and through the passage in abutment 30. The deck units may be pushed outwardly to an extent of, for example, 150 feet from the abutment 30, thereby providing for bridging of a depression of such width, even though the opposite bank of the depression is occupied by hostile forces. After clearing the area of such hostile forces, the second abutment may be transported across the partially completed bridge, and erected on the far side, in the same manner as the first abutment 30, with the positioning of the deck units 100 through the passage thereof. The bridge may be completed by the addition of the ramps 123**.

It will be obvious to those skilled in the art that various changes may be made without departing from the spirit of the invention, and therefore the invention is not limited to what is shown in the drawings and described in the specification but only as indicated in the appended claims.

I claim:

1. A collapsible abutment for a transportable bridge, comprising:

a base of generally rectangular plan form;

a pair of rigid backstays having first ends pivotally connected to one end of said base on opposite sides thereof, and lying in substantially the same plane as the base when in a collapsed position;

a pair of rigid beam columns having first ends thereof pivotally connected to the other end of said base on opposite sides thereof, and lying in substantially the same plane as the base when in a collapsed position; and means on the second ends of said backstays and said beam columns for automatically securing said second ends together when the backstay and columns are rotated into an executed position.

2. An abutment as set forth in claim 1, said second ends of said backstay and beam-column on one side of said base being in adjacent planes, and said securing means comprising a pin extending from said beam-column across said backstay.

3. An abutment as set forth in claim 2, said securing means further comprising downwardly facing hook means at said second ends of said backstays for receiving said pins.

4. An abutment as set forth in claim 1, and further comprising a pair of reaction beams each pivotally connected at one end thereof to a said beam column and extending from said pivotal connection over said one end of said base.

5. An abutment as set forth in claim 4, and a pair of hydraulic jacks each mounted on said base adjacent opposite sides thereof and near said one end, said jacks each underlying and engageable with said reaction beam.

6. An abutment as set forth in claim 5, said reaction beams extending substantially past said one end of said base, whereby a downward reactive force may be applied to the ends thereof remote from the ends pivotally connected to said beam columns.

7. An abutment as set forth in claim 4, said reaction beams extending substantially past said one end of said base, whereby a downward reactive force may be applied to the ends thereof remote from the ends pivotally connected to said beam columns.

8. An abutment as set forth in claim 4, said beam columns each comprising a lower portion outwardly of either side of said base, an upper portion inwardly offset from said lower portion, and a transverse connecting portion connecting said upper and lower portions, said reaction beam being pivotally connected to said beam column above said connecting portion.

9. An abutment as set forth in claim 8, said beam column lower portions extending above said connecting portions thereof and said reaction beam one ends being between said beam column upper and lower portions and pivotally connected to both said portions.

10. An abutment as set forth in claim 1, said beam columns each comprising a transverse portion extending inwardly and overlying said base, said transverse portion having a bottom surface spaced above said base a distance sufficient to permit passage of a deck unit between said transverse portion and said base.

11. An abutment as set forth in claim 10, and anti-friction means carried by said transverse portions at the bottom surface thereof.

12. An abutment as set forth in claim 10, and further comprising a pair of reaction beams each connected at one end thereof to a said beam column and extending therefrom toward said one end of said base.

13. An abutment as set forth in claim 12, means for anchoring said reaction beams against movement thereof, said reaction beams each having a haunch portion extending above said base and defining with said base a passage for a deck unit.

14. An abutment as set forth in claim 13, each said extending haunch portion of said reaction beams providing a downwardly facing guiding surface for cooperation with a deck unit passed between said reaction beam and said base.

15. An abutment as set forth in claim 14, and further comprising a deck unit associated therewith, said deck unit being of generally rectangular plan form and of small thickness relative to its length and width and dimensioned to pass between said beam columns and said base.

16. The structure of claim 15, said deck unit having a laterally extending bearing means at either side thereof for engaging the said guiding surfaces of said reaction beams.

17. The structure of claim 16, said deck units comprising means for connecting plural deck units together in longitudinal alignment, cable means extending from said abutment, and means for connecting said cable means to a said deck unit extending beyond said abutment.

18. The structure of claim 17, said last mentioned means comprising said bearing means.

19. The structure of claim 17, further comprising anchoring means for said cable positioned on said backstays.

20. An abutment as set forth in claim 10, and deck support plate means carried by said base other end and underlying said transverse portion, said transverse portion and plate means providing a passage for a deck unit therebetween.

21. An abutment as set forth in claim 20, and means connecting said beam columns to said plate means for rotation of said plate means with said beam columns.

22. An abutment as set forth in claim 1, and deck support plate means at the other end of said base and supported by said base.

23. An abutment as set forth in claim 22, and means pivotally supporting said plate means on said base.

24. An abutment as set forth in claim 23, said last mentioned means comprising means for rotating said plate means with said beam columns.

25. An abutment as set forth in claim 24, wherein said plate means comprises a pair of spaced apart plates, each positioned near a side of said base.

26. An abutment as set forth in claim 12, said deck unit having a laterally extending bearing means at either side thereof for engaging the said guiding surfaces of said reaction beams.

27. An abutment as set forth in claim 26, and anti-friction means carried by each said plate at the upper surface thereof.

28. An abutment as set forth in claim 1, further comprising extendable legs supported by said columns.

29. In a transportable bridge, an abutment comprising a base, a pair of generally elongate structural members pivotally connected at opposite sides of one end of said base and having a first position wherein said members have a low height above said base and a second erected use position wherein upper portions of said members have a relatively great height above said base, said members each including a transverse portion extending inwardly and overlying said base, said transverse portion having a bottom surface spaced above said base a distance sufficient to permit passage of a deck unit between said transverse portions and said base.

30. The structure of claim 29, and further comprising a deck unit associated therewith, said deck unit being of generally rectangular plan form and of small thickness relative to its length and width and dimensioned to pass between said members and said base.

31. The structure of claim 30, said base being elongate and deck support plate means supported by said base thereof and extending longitudinally of and away from said base, to support a deck unit extending beyond said base.

32. The structure of claim 31, and means pivotally supporting said plate means on said base.

33. The structure of claim 32, and means connecting said deck support plate means and said structural members for pivotal movement therewith.

34. The structure of claim 30, and further comprising a reaction beam connected to each said member and extending in the erected use position of said abutment longitudinally of and over said base, means anchoring said reaction beams against movement, said reaction beams each having a haunch portion extending above said base and defining with said base a passage for said deck unit.

35. The structure of claim 32, each said extending haunch portion of said reaction beams providing a downwardly facing guiding surface for cooperation with a deck unit passed between said reaction beam and said base.

36. The structure of claim 35, said deck unit having a laterally extending bearing means at either side thereof for engaging the said guiding surfaces of said reaction beams.

37. The structure of claim 36, said deck units including means for connecting plural deck units together in longitudinal alignment, cable means extending from said abutment, and means for connecting said cable means to a said deck unit extending beyond said abutment.

38. A deck unit for a transportable bridge, comprising:

a plurality of interconnected, longitudinally extending bars providing a long, wide and thin load support means;

a pair of surface plates on said support means, the surface plates extending along the length of the support means to provide a vehicular surface thereon; and a pair of cover plates connected so as to extend each surface plate a short distance beyond said support means, said cover plates being located at diagonally opposite ends of said support means.

39. The deck unit of claim 38, and coupler means carried by each said bar at each end thereof for coupling one said deck unit to a like said deck unit.

40. A deck unit as set forth in claim 39, and having means comprising a bearing element extending transversely through said deck unit.

41. A method of erecting a bridge across a depression, comprising:

a. providing a bridge abutment comprising elements pivotally joined to a base to provide a low collapsed height for transport, and a greater erected height for use;

b. transporting a said abutment in collapsed condition to an abutment site on one bank;

c. erecting said abutment;

d. anchoring said abutment to said site;

e. providing a plurality of deck units of generally flat, rectangular shape, having end-to-end couplers and dimensioned to pass axially through said abutment;

f. connecting said deck units in end-to-end relationship;

g. attaching cables to said abutment and at least one of said deck units for supporting said deck units; and h. passing said deck units through said abutment from said abutment site across said depression so that the leading deck unit engages the opposite bank.

42. The method of claim 41, and further comprising:

a. transporting a second abutment in collapsed condition through said first abutment on said deck units to said opposite bank, b. erecting said second abutment on said opposite bank, c. connecting said second abutment to at least one said deck unit adjacent said opposite bank, and d. anchoring and said second abutment to said opposite bank.

43. The method of claim 44, and further comprising extending a cable through said deck units, and applying tension to said cable to stress said deck units.

* * * * *